US005531361A

United States Patent [19]

Podd

[11] Patent Number: 5,531,361

[45] Date of Patent: Jul. 2, 1996

[54] ACTIVE BULKHEAD CORNER WITH ENHANCED COMMODITY DISCHARGE

[76] Inventor: Victor T. Podd, 255 Beverly Avenue, Montreal, Quebec, Canada, H3P 1K8

[21] Appl. No.: 296,532

[22] Filed: Aug. 26, 1994

[51] Int. Cl.[6] ..... B65D 83/00

[52] U.S. Cl. ..... 222/198; 222/203

[58] Field of Search ..... 222/94, 105, 180, 222/198, 199, 203, 202; 105/239, 201.2, 270, 279

[56] References Cited

U.S. PATENT DOCUMENTS

| | | | |
|---|---|---|---|
| 2,712,797 | 7/1955 | Woehrle et al. | 105/367 |
| 3,275,197 | 9/1966 | Eklund | 222/203 |
| 3,756,469 | 9/1973 | Clark et al. | 222/105 |
| 4,054,226 | 10/1977 | Bjelland et al. | 220/63 |
| 4,124,136 | 11/1978 | Bjelland et al. | 220/68 |
| 4,232,803 | 11/1980 | Muller et al. | 222/105 |
| 4,251,013 | 2/1981 | Krause | 222/198 |
| 4,557,400 | 12/1985 | Clarke | 222/105 |
| 4,799,607 | 1/1989 | Podd | 222/94 |
| 4,810,156 | 3/1989 | Pendleton et al. | 222/203 |
| 4,884,722 | 12/1989 | Podd | 222/535 |
| 5,024,346 | 6/1991 | Roser | 220/401 |
| 5,193,710 | 3/1993 | Podd, Sr. et al. | 220/403 |

FOREIGN PATENT DOCUMENTS

| | | | |
|---|---|---|---|
| 538563A2 | 4/1993 | European Pat. Off. . | |
| 4294779 | 10/1992 | Japan | 222/203 |

*Primary Examiner*—Andres Kashnikow
*Assistant Examiner*—Philippe Derakshani
*Attorney, Agent, or Firm*—John C. Smith

[57] ABSTRACT

An active bulkhead corner unit with a support surface that faces the cargo and inflatable bags located underneath the support surface. The inflatable bags occupy the space between the support surface, the floor of the container, and the adjacent walls of the container. A vibrating mechanism such as a flutter valve is attached to the pressure pump to create rapid variations in pressure which in turn cause the inflatable bag and the support surface to vibrate against the cargo, disturbing the cargo and enhancing discharge flow. The bulkhead corner can be an independent unit or integrated with a liner.

57 Claims, 8 Drawing Sheets

Prior Art

ACTIVE BULKHEAD CORNER WITH ENHANCED COMMODITY DISCHARGE

BACKGROUND OF THE INVENTION

1. Technical Field

The present invention relates to the loading and unloading of flowable cargo transported in lined or unlined bulk cargo containers. In particular, it relates to inflatable corner bag assemblies for use in guiding bulk commodity materials to an outlet port in a cargo transport bulkhead.

2. Background Art

Transportation of containers for bulk commodity products (grains, etc) have been implemented using a variety transport vehicles, such as trucks, railroads, and ships. An important economic factor in the transportation of bulk commodities is the speed and ease with which the commodities are loaded onto and unloaded from the container.

Typical methods of loading and unloading the containers are pressure systems such as pumps to force commodities into the container during loading and to provide suction to remove the commodities during unloading. Another popular method is the use of gravity mechanisms. For example, gravity may be used to unload a container by tilting the container such that the bulk commodity flows toward a discharge door at one end of the container.

While both of these methods are generally effective, the unloading process can be improved by more precisely controlling the direction of the bulk material as it flows toward the discharge door. In the prior art approach of merely raising the container to allow most of the bulk commodity to flow out results in some of the commodity remaining in the corners of the container. This creates the additional labor expense of manually removing the residual commodity trapped in the corners. In addition to the labor expense required to remove the residual commodity product from the corners, the economic efficiency of the container and transport vehicle is reduced due to the delay involved with this additional step in the unloading procedure.

This problem was addressed in U.S. Pat. No. 4,799,607 to Podd wherein rigid angled corners, hinged to a bulkhead, were used to direct the commodity flow in the direction of the discharge door. This approach alleviated the problem associated with accumulation of commodity residue in the corners of the container.

While addressing the basic desirability of controlling product flow in bulk commodity container systems during unloading, the prior art has centered on passive systems such as a stationary corner. The prior art has not provided an active corner system which assists the flowing of cargo during discharge by active inducement of vibration to reduce settling of cargo and increase the motion of individual cargo particles.

SUMMARY OF THE INVENTION

The present invention solves the foregoing problems by providing inflatable bulkhead corner units which have a rigid or flexible surface that faces the cargo and inflatable bags located underneath the surface. The inflatable bags occupy the space between the rigid surface, the floor of the container, and the adjacent walls of the container. A vibrating mechanism such as a flutter valve is attached to the pressure pump to create rapid variations in pressure which in turn cause the inflatable bag and the rigid surface to vibrate against the cargo, disturbing the cargo and enhancing discharge flow.

DESCRIPTION OF THE PREFERRED EMBODIMENT

Figure 1:
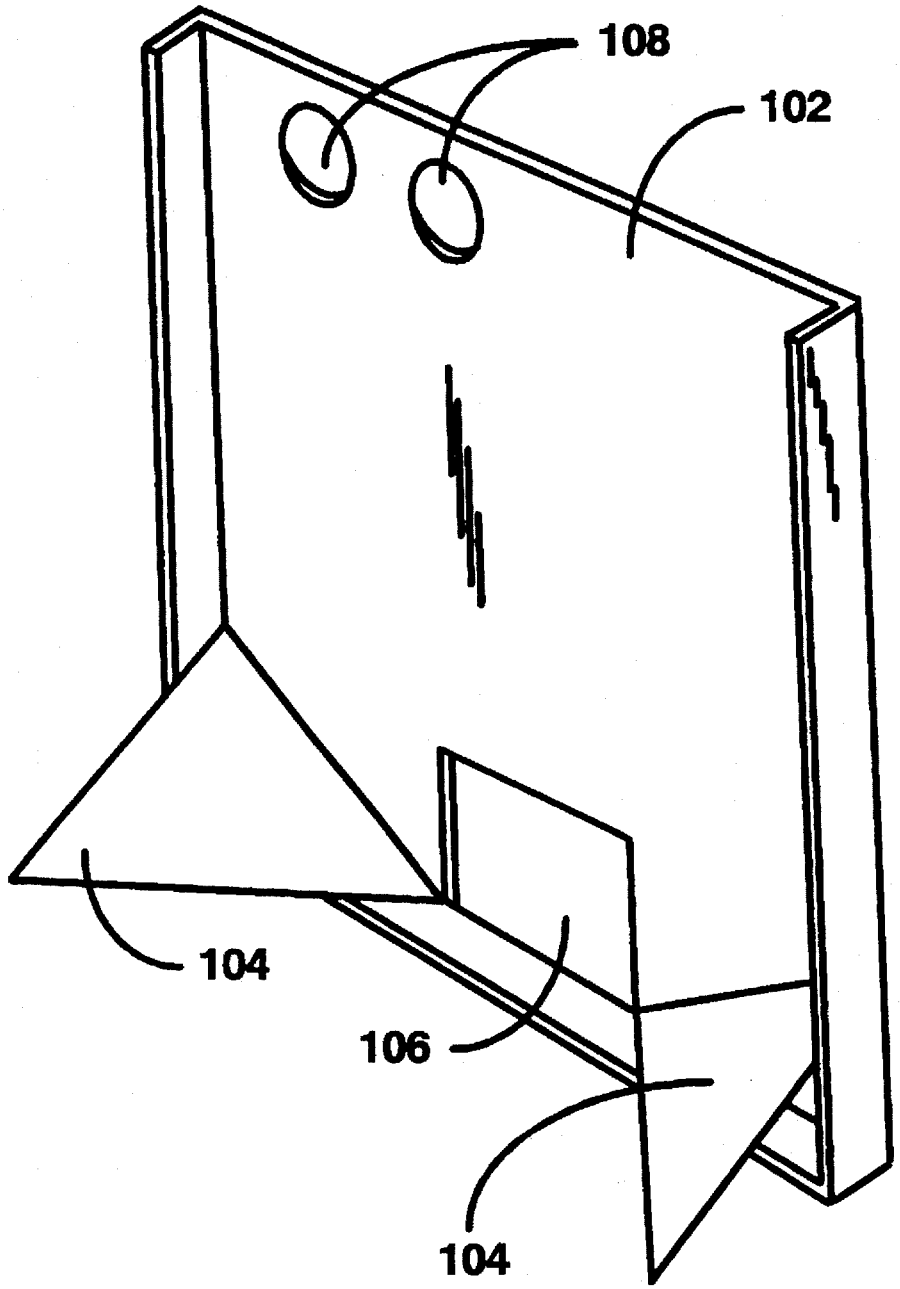
FIG. 1 is a diagram of a prior art rigid corner.

Referring to FIG. 1, this figure shows a prior art approach using rigid corners 104. Bulkhead 102 has discharge door 106 located at its base to allow discharge of cargo from the liner. Load/Vent holes 108 are located near the top of the bulkhead. Rigid corners 104 are attached at the sides of the bulkhead. The slope of the corners directs the bulk cargo to discharge door 106 such that portions of the cargo are not trapped in the corners of the container when the container is unloaded.

Figure 2:
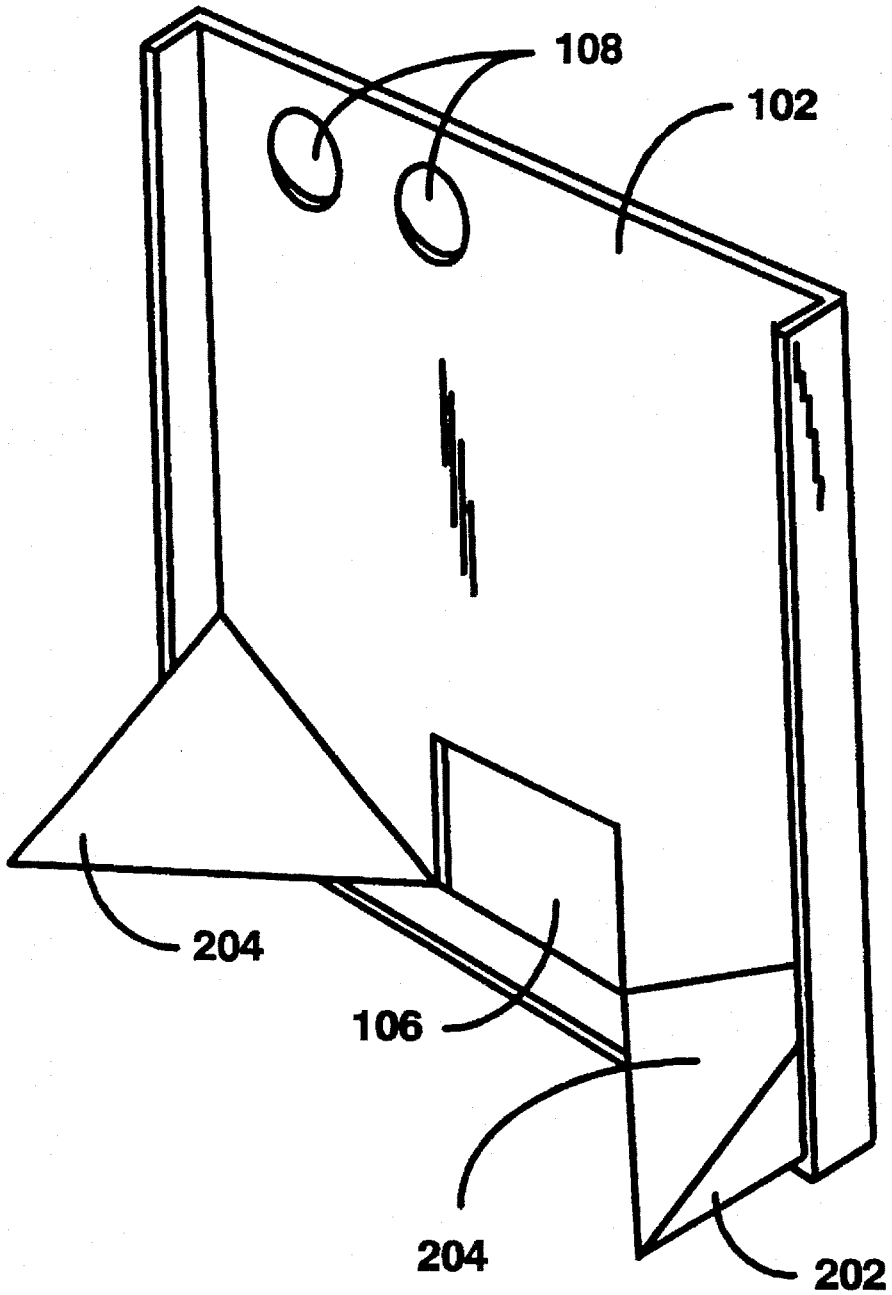
FIG. 2 is an interior view of a bulkhead equipped with an inflatable/corner unit.

FIG. 2 illustrates the inflatable corner units 202 used by the invention disclosed herein. For ease of illustration, some structural details of corner units 202 were omitted in FIG. 2. These details will be more fully discussed below, in regard to FIG. 3. The corner units 202 are shown inflated for use with bulk cargo. When unloading the cargo, the corner units 202 provide the same directional control over cargo flow as the prior art rigid corners. However, in addition to controlling cargo flow direction as is done by prior art devices, the active corner units 202 of this invention enhance cargo discharge flow by vibrating during discharge to discourage settling of cargo and further to enhance flow rate. The vibration effect and the structural details of the corner units 202 will be discussed more fully below. This specification uses the term "air" pressure to describe the pressure levels inside the corner units. For the purposes of this disclosure, the term "air" defines not only ambient air, but any suitable gas which can be substituted for ambient air to achieve the desired result.

For ease of illustration, the support surfaces 204 of corner units 202 which face the cargo are illustrated as rigid surfaces. Indeed, one method of constructing these surfaces is to utilize a hard material such as plywood, plastic, etc. However, those skilled in the art will recognize that any number of flexible materials may also be used providing that the resulting surface can effectively guide the cargo to discharge door 106 without excessive deformation. Examples of such a material would be heavy gauge polyethylene or polypropylene sheets in the approximate range of sixty (60) mils in thickness. Therefore, for the purpose of this disclosure, it is understood that the term "support"

surfaces encompasses both materials which form "rigid" surfaces as well as surfaces which are "flexible," such as the heavy gauge polyethylene and polypropylene sheets discussed above.

Figure 3:
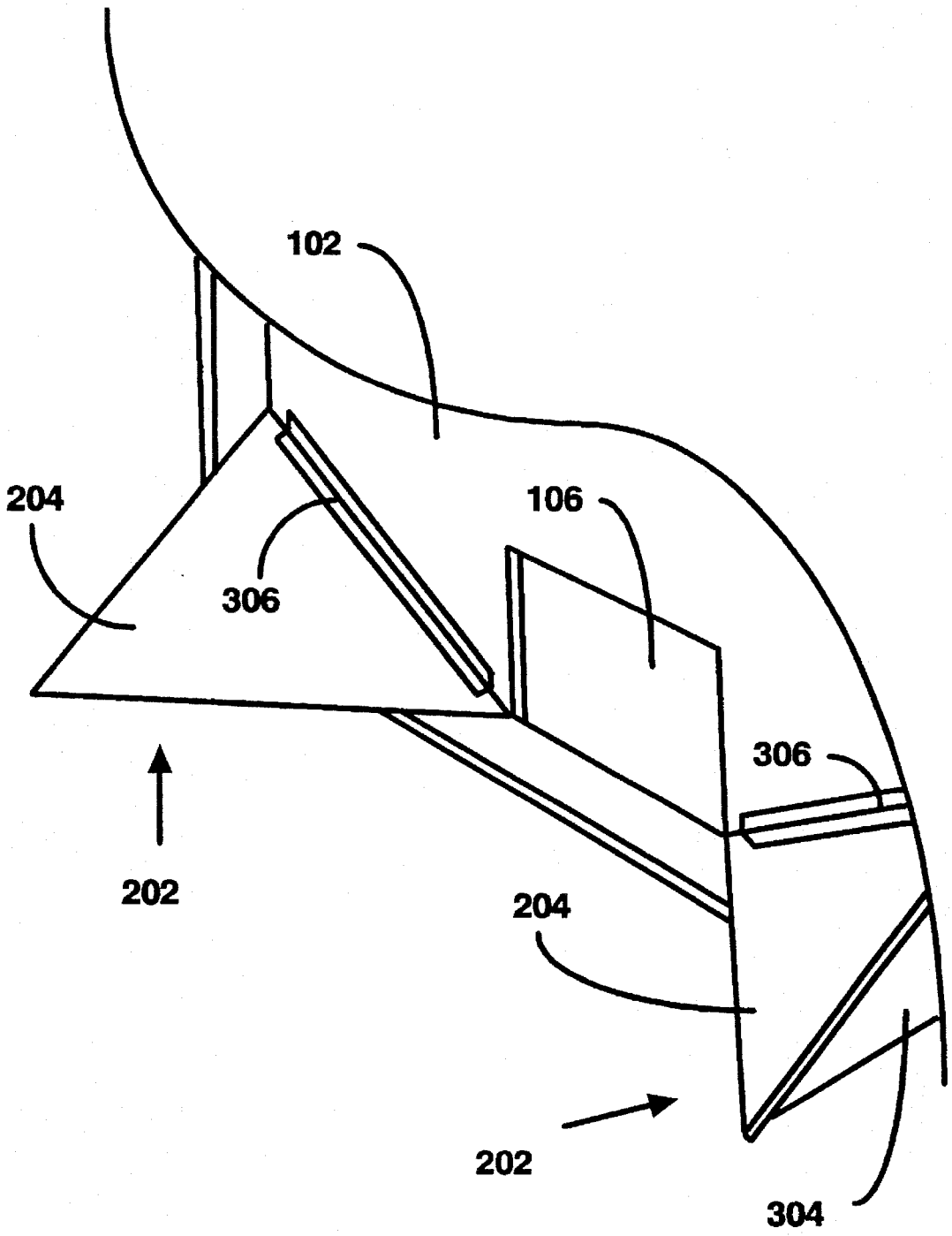
FIG. 3 is a detailed cutaway interior view of the bulkhead shown in FIG. 2.

FIG. 3 shows a closeup cutaway view of the corner units 202. Corner units 202 have a support surface 204 which faces the cargo or liner 502. In the preferred embodiment, support surface 204 is attached to bulkhead 102 by hinge 306. However, those skilled in the art will recognize that any number of conventional methods of securing corner units 202 may be employed. Underneath support surface 204 is inflatable bag 304. During unloading, inflatable corner bags 304 create a vibration under control of flutter valve 404 (shown in FIG. 4) and pump 602 (shown in FIG. 6). The preferred inflation medium is contemplated as air, but any suitable gas, liquid, or air may be used to provide internal pressure. By providing a support surface 204, undesirable changes in the surface shape of corner units 202 are avoided. In addition, the effect of the vibration is maximized by the support surface 204 in that the vibration is not dampened as it might be if a flexible surface were used instead of support surface 204.

Inflatable bags 304 may be fabricated from any suitable material such as polyethylene, polypropylene, vinyl, kraft paper laminates, etc. The only requirement is that the material be suitable for the particular cargo (i.e., it will not react or contaminate cargo such as food, etc.). Inflatable bags 304 are secured to the bulkhead 102 and/or container (not shown) by straps or tie downs (not shown). Those skilled in the art will recognize that any other suitable method of securing inflatable bags 304 may be used. For example, adhesive could be used to secure the inflatable bags 304 to bulkhead 102. Also, inflatable bags 304 can be constructed as an independent unit or integrated with support surface 204. In an alternative embodiment, liner 502, inflatable bag 304, and support surface 204 may be integrated into a single disposable unit.

Support surface 204 can be fabricated from any material, such as wood, corrugated board, metal, plastics, etc. The preferred embodiment envisions plywood, which combines strength with low cost.

Figure 4:
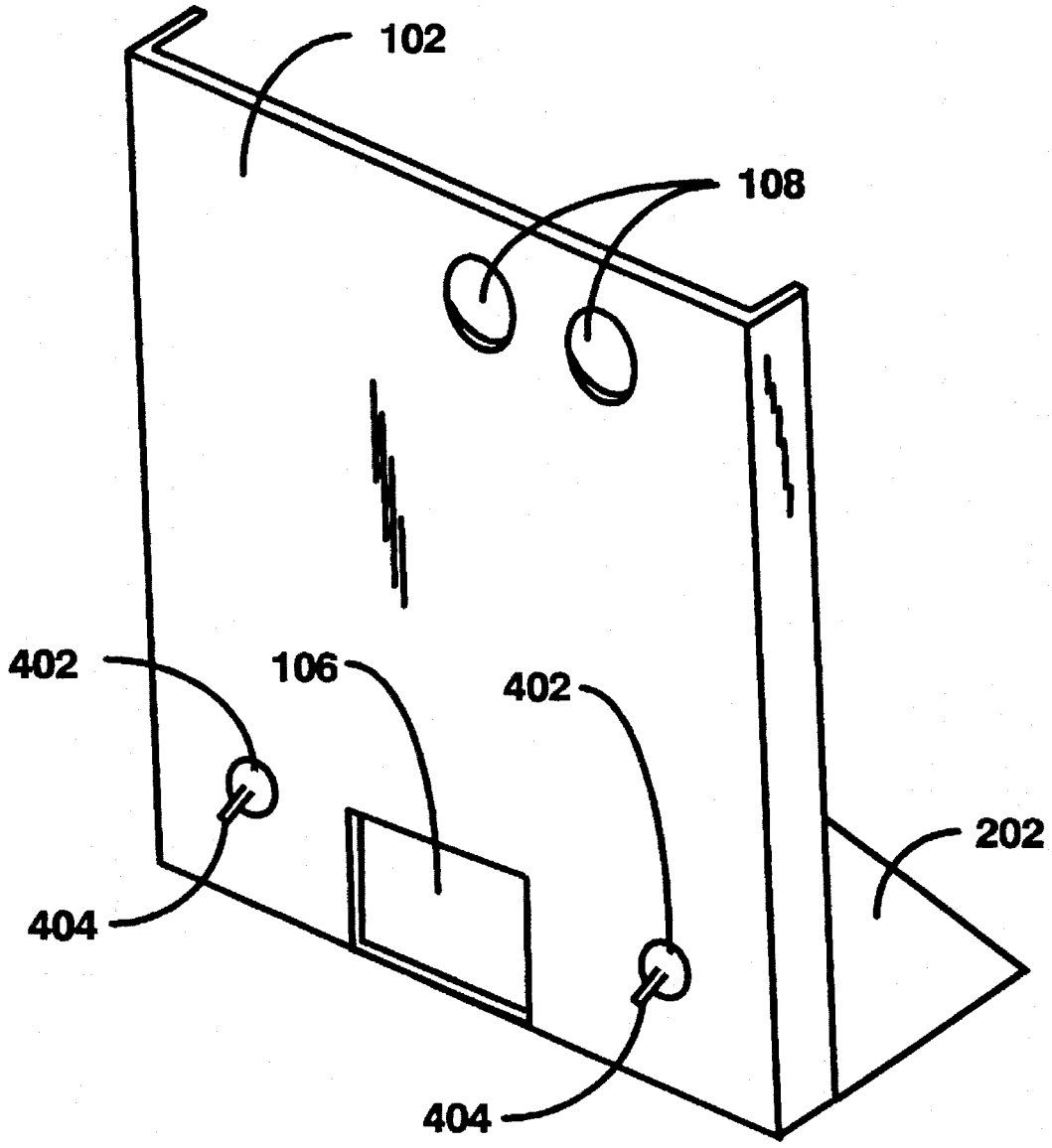
FIG. 4 is an exterior view of a bulkhead, and an inflatable corner unit.

FIG. 4 shows an exterior view of bulkhead 102. Inflatable corner unit 202 is shown on the interior side of bulkhead 102. Apertures 402 are provided in bulkhead 102 to allow easy access to the flutter valves 404 of inflatable corner bags 202. Flutter valves create a rapid start stop motion to air flow entering corner units 202. The effect of the air flow variation is to create a vibration in inflatable bags 304 which is in turn applied to the cargo through support surface 204. Flutter valves 404 are well known in the art.

Figure 5:
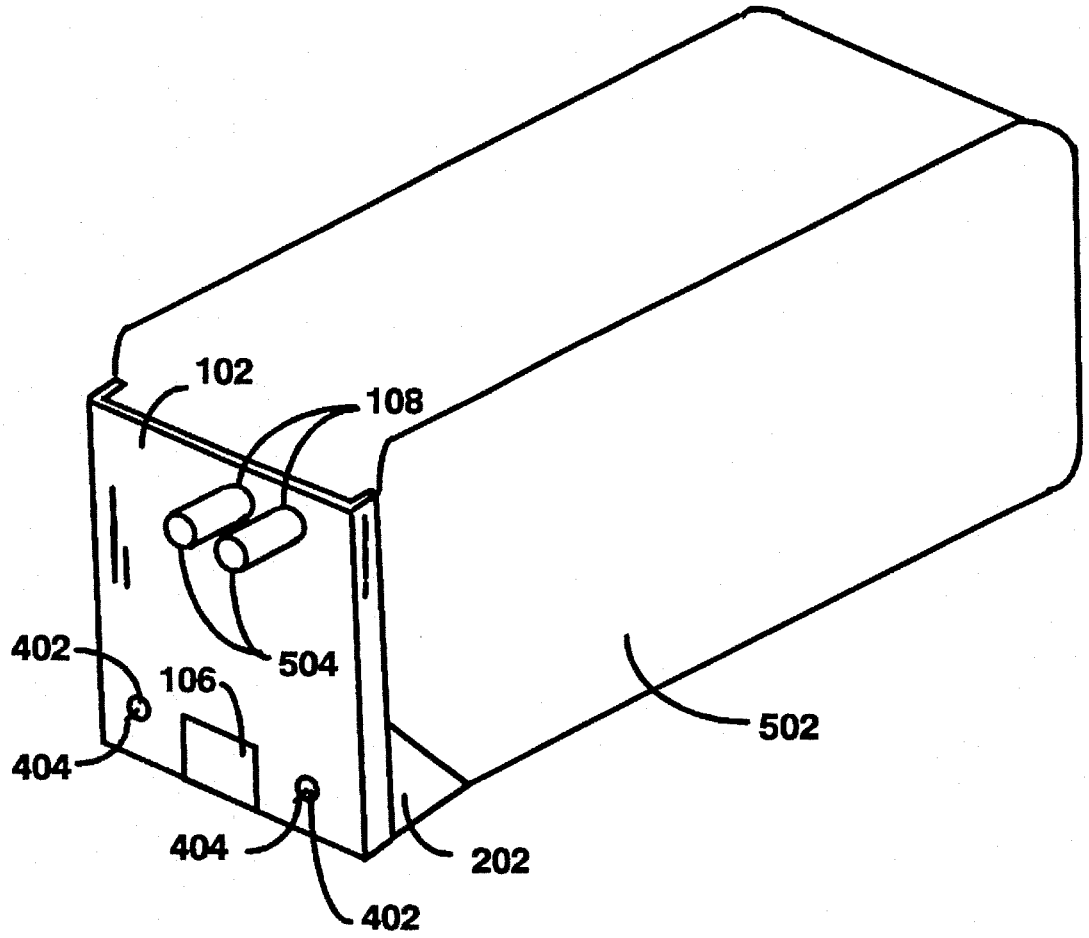
FIG. 5 is an exterior view of a bulkhead, an inflatable corner unit, and a liner.

FIG. 5 shows a liner 502 used in conjunction with the bulkhead 102 and the inflatable corner units 202. Tubes 504 provide access to load/vent liner 502. As can be seen, inflatable corner units 202 lift the base of liner 502 resulting in a sloping of the liner bag toward the discharge door 106. For ease of illustration, inflatable corner bags 202 were shown throughout this specification as devices which are separate from the bulkhead. However, they can easily be integrated with bulkhead 102 such that bulkhead 102 and inflatable corner units 202 comprise a single device for ease of installation. Likewise, those skilled in the art will recognize that inflatable corner units 202 can also be manufactured as part of liner 502. Whether the inflatable corner units 202 are independent devices, part of the bulkhead 102, or part of the liner 502 is of no concern so long as the inflatable corner units 202 are accessible for connection of a pump 602 to the flutter valve 404 and capable of vibration to enhance the flow rate of the bulk commodity cargo.

Flutter valve 404 can be integrated with a corner unit 202 or implemented as a separate unit. For ease of illustration, the flutter valve 404 is shown as part of corner units 202. However, the preferred embodiment envisions the flutter valve 404 as a separate unit outside of the container and incorporated into pump 602 which results in lower cost than integrating flutter valve 404 in corner unit 202 because it is reusable if not integrated into corner units 202. Further, the inflatable corner units 202 were shown as approximately equal in size. In the event the discharge door 106 is offset to one side of bulkhead 102, the size and angle of inflatable corner units 202 may vary to ensure that adequate control of flow direction is obtained by both inflatable corner bags 202. It is also possible to design a bulkhead 102 with discharge door 106 offset to one side of bulkhead 102 such that only a single corner unit 202 is required.

While flutter valves 404 are used in the preferred embodiment, any suitable vibration generation means can be used. For example, mechanical vibration generators, or sonic generators using sonic or ultrasonic frequencies can be used. In addition, so long as the desired amount of vibration is achieved, the vibration means can be attached to corner units 202, to the inside or outside of bulkhead 102, or to the wall or floor of container 604 (shown in FIG. 6). The only requirement is that corner units 202 be caused to vibrate such that cargo flow is enhanced.

Figure 6:
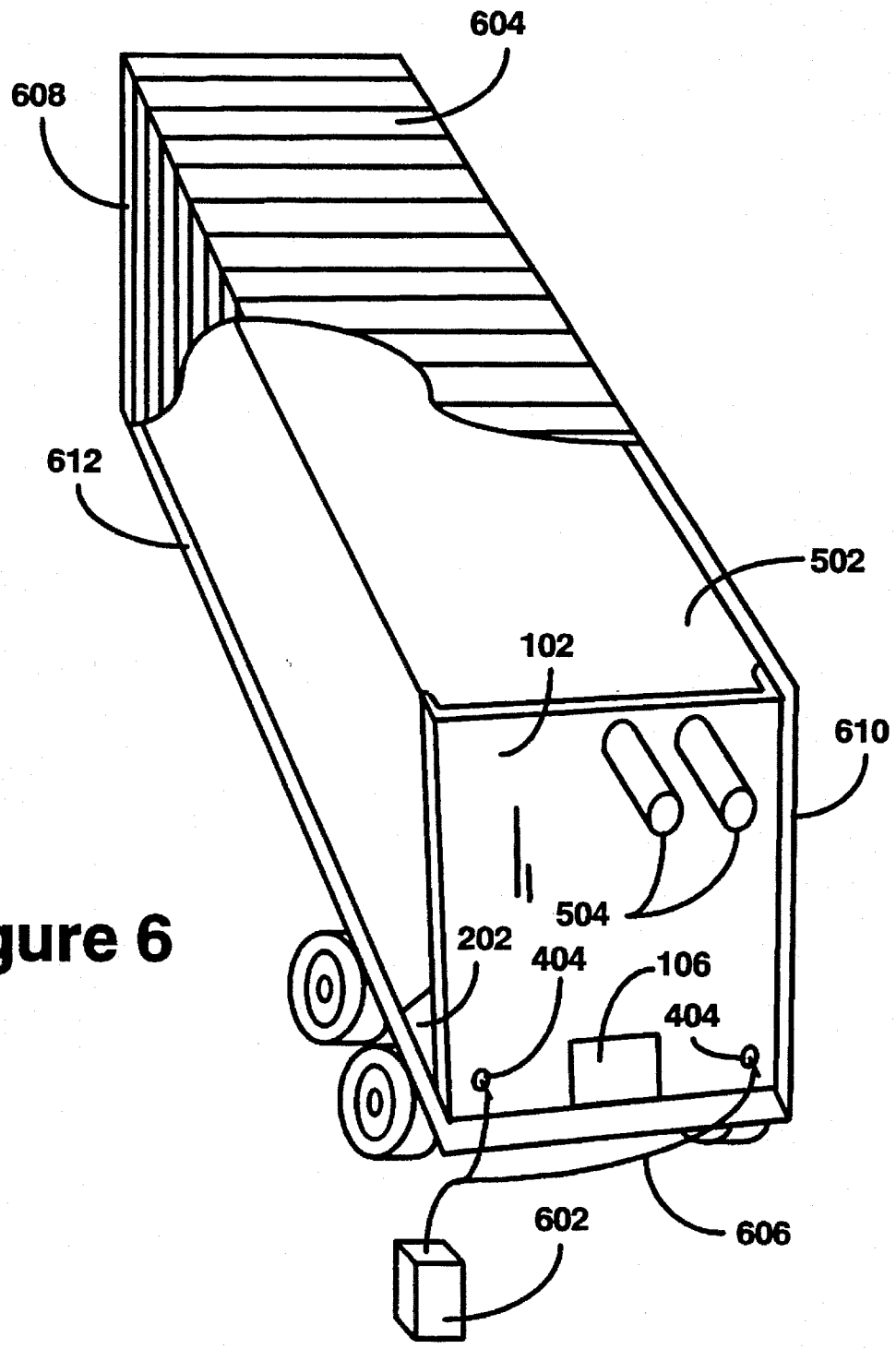
FIG. 6 is a cutaway exterior view of a container showing a bulkhead, flutter valves, inflatable corner units, a liner, and a pressure pump.

FIG. 6 a cutaway view showing liner 502 installed in container 604 which has first and second side walls 608, 610, and floor 612. Bulkhead 102 is shown mounted in the end of container 604 between side walls 608, 610. A corner unit 202 is shown mounted at the intersection of first side wall 608, floor 612 and bulkhead 102. Load/vent tubes 504 provide the loading path for the cargo. Discharge port 106 provides the discharge path for the cargo. Pump 602 provides a source of air pressure which is pumped through hoses 606 to flutter valves 404. While separate pumps 602 can be used for each flutter valve 404, the preferred embodiment envisions a single pump 602 driving both flutter valves 404. Flutter valve 404 and pump 602 can be stored in any convenient location at the receiving site or on the container vehicle. Where appropriate, pump 602 can be stored at the destination location and shared among many vehicles. Air pressure pumps are well known in the art. In practice, a vehicle operator can quickly attach pump 602 and flutter valves 404 from outside of the vehicle to assist in unloading the cargo. A preferable method is to integrate flutter valve 404 and pump 602 into a single unit to facilitate ease of use.

Figure 7:
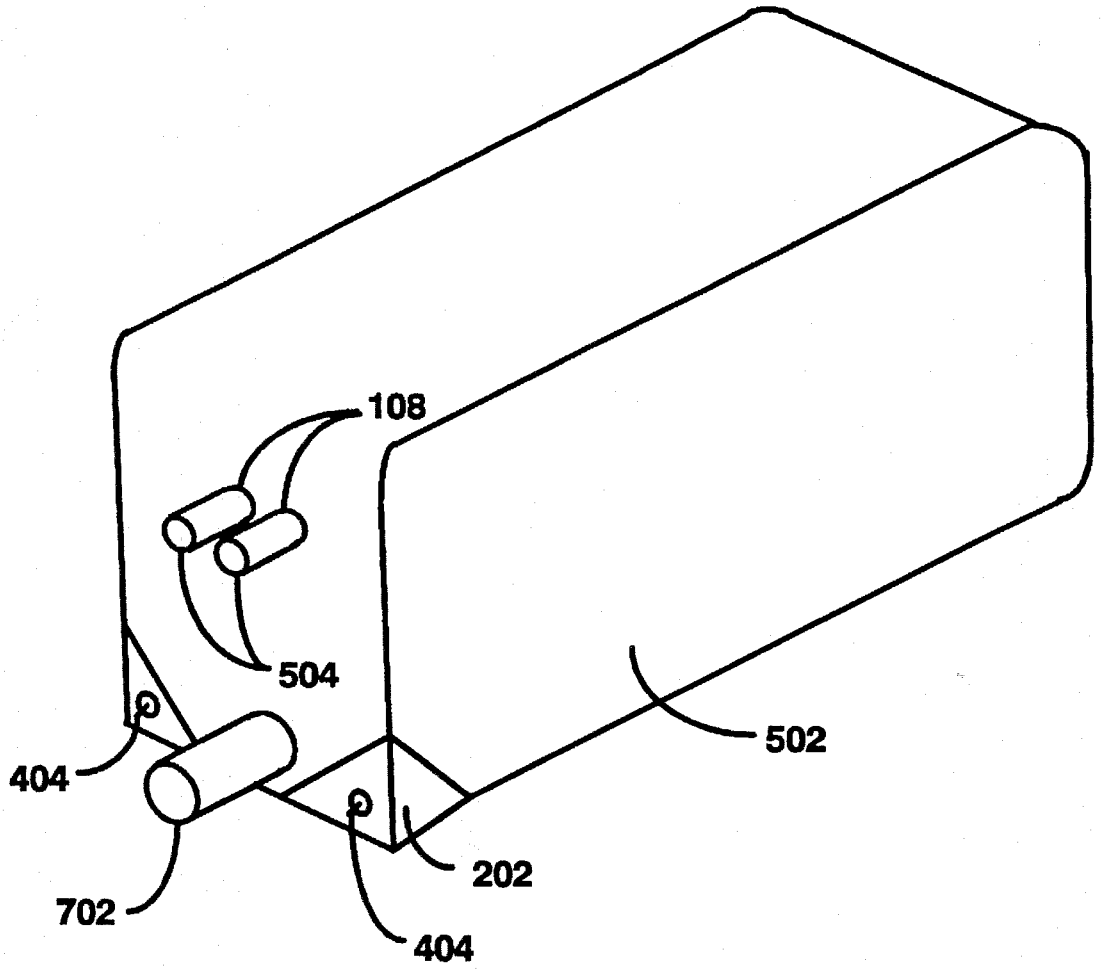
FIG. 7 is an alternative embodiment showing flutter valves, inflatable corner units, and liner integrated into a single device.

FIG. 7 shows an alternative embodiment in which the liner 502 and corner unit 202 are integrated into a single device. Discharge channel 702 shows a typical channel which would extend through discharge door 106 for unloading. In this embodiment, support surface 204 is held in place by heat sealing the inflatable corner bag 304 to liner 502 around the periphery of support surface 204. Heat sealing methods for liner material are well known in the art.

Figure 8:
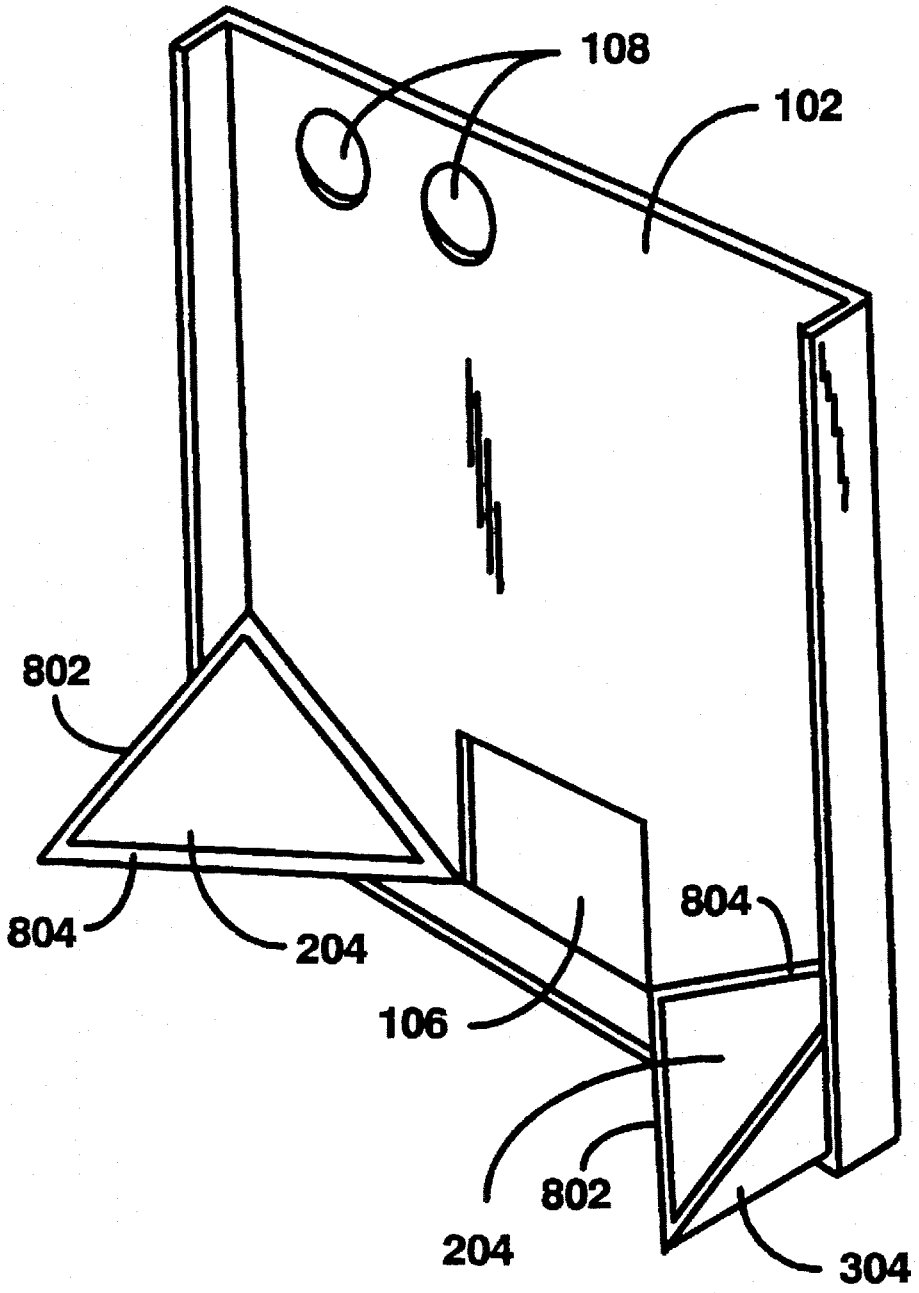
FIG. 8 is an alternative embodiment showing an inflatable bag and rigid surface integrated into a single device.

FIG. 8 shows an alternative embodiment in which the inflatable bag 304 and support surface 204 are integrated into a single device. In this embodiment, a flexible layer 804 of material, preferably the same as that used for the inflatable bag, is placed over the side of the support surface 204 which faces away from inflatable bag 304. Flexible layer 804 is heat sealed to inflatable bag 304 along seam 802, encapsulating support surface 204. Heat sealing methods for liner material are well known in the art. For ease of illustrating the sealing of flexible layer 804 to seam 802, inflatable bag 304 was shown as being larger in size than support surface 204. However, in the preferred embodiment, flexible layer 804 will wrap around the side of support surface 204 to seal to smaller inflatable bag 304 at seam 802.

As mentioned above in the discussion of FIG. 2, flexible material such as a thick layer of polyethylene or polypropylene can also be used to construct surface 204. When using these materials, and in addition to the encapsulation method discussed above, a variety of methods can be used to join surfaces 204 to corner units 202, including heat sealing, chemical bonding, adhesives, etc.

An alternative embodiment of corner units 202 can also be employed which utilizes reinforced layers of material to provide protection against corner unit 202 failure. In this embodiment, woven layers of polyethylene or polypropylene can be laminated to the outside of corner units 202 to increase the structural strength of corner units 202. While the preferred embodiment envisions layers approximately four (4) to six (6) mils thick, the thickness of these layers is not important and any suitable thickness may be selected so long as the ability of corner units 202 to vibrate is not significantly impaired.

While the invention has been described with respect to a preferred embodiment thereof, it will be understood by those skilled in the art that various changes in detail may be made therein without departing from the spirit, scope, and teaching of the invention. For example, the vibration mechanism may vary, support corner and inflatable corner bag construction materials can vary, and the corners may be independent devices or integrated into a liner. Accordingly, the invention herein disclosed is to be limited only as specified in the following claims.

I claim:

1. An active bulkhead corner for use with a cargo container bulkhead, comprising:

an inflatable bag, positioned upon inflation in a corner of a cargo container at an intersection of a floor of the cargo container, a first wall of a cargo container bulkhead and a second side wall of the cargo container, the bag configured upon inflation to displace cargo from the corner of the cargo container;

a support surface, the support surface having one side in contact with the inflatable bag, the support surface further having a first edge substantially parallel to the first wall of the cargo container bulkhead, a second edge substantially parallel to the second side wall of the cargo container, and a third edge substantially parallel to the floor of the cargo container.

2. An active bulkhead corner, as in claim 1, wherein the support surface and the inflatable bag are integrated into a single unit.

3. An active bulkhead corner, as in claim 2, further comprising:

a flexible layer located above the support surface on the side opposite the inflatable bag;

a seal attaching the flexible layer to the inflatable bag around the periphery of the support surface such that the support surface is enclosed by the flexible layer and the inflatable bag.

4. An active bulkhead corner, as in claim 1, further comprising attachment means to provide an input for air pumped under pressure to the inflatable bag.

5. An active bulkhead corner, as in claim 4, further comprising means to vibrate the inflatable bag when the inflatable bag is in contact with the support surface such that the inflatable bag causes the support surface to vibrate.

6. An active bulkhead corner, as in claim 5, wherein the means to vibrate the inflatable bag includes a flutter valve.

7. An active bulkhead corner, as in claim 5, wherein the means to vibrate the inflatable bag includes a mechanical vibrator.

8. An active bulkhead corner, as in claim 5, wherein the means to vibrate the inflatable bag includes a sonic vibrator.

9. An active bulkhead corner, as in claim 1, further comprising means to vibrate the inflatable bag when the inflatable bag is in contact with the support surface such that the inflatable bag causes the support surface to vibrate.

10. An active bulkhead corner, as in claim 9, wherein the means to vibrate the inflatable bag includes a flutter valve.

11. An active bulkhead corner, as in claim 9, wherein the means to vibrate the inflatable bag includes a mechanical vibrator.

12. An active bulkhead corner, as in claim 9, wherein the means to vibrate the inflatable bag includes a sonic vibrator.

13. An active bulkhead corner, as in claim 2, further comprising attachment means to provide an input for air pumped under pressure to the inflatable bag.

14. An active bulkhead corner, as in claim 13, further comprising means to vibrate the inflatable bag when the inflatable bag is in contact with the support surface such that the inflatable bag causes the support surface to vibrate.

15. An active bulkhead corner, as in claim 14, wherein the means to vibrate the inflatable bag includes a flutter valve.

16. An active bulkhead corner, as in claim 14, wherein the means to vibrate the inflatable bag includes a mechanical vibrator.

17. An active bulkhead corner, as in claim 14, wherein the means to vibrate the inflatable bag includes a sonic vibrator.

18. An active bulkhead corner, as in claim 2, further comprising means to vibrate the inflatable bag when the inflatable bag is in contact with the support surface such that the inflatable bag causes the support surface to vibrate.

19. An active bulkhead corner, as in claim 18, wherein the means to vibrate the inflatable bag includes a flutter valve.

20. An active bulkhead corner, as in claim 18, wherein the means to vibrate the inflatable bag includes a mechanical vibrator.

21. An active bulkhead corner, as in claim 18, wherein the means to vibrate the inflatable bag includes a sonic vibrator.

22. A liner assembly having an integrated active bulkhead corner for use with a cargo container, comprising:

a liner;

an inflatable bag, attached to the liner and positioned upon inflation in a corner of the cargo container at an intersection of a floor of the cargo container, a first wall of a cargo container bulkhead and a second side wall of the cargo container, the bag configured upon inflation to displace cargo from the corner of the cargo container;

a support surface, the support surface having one side in contact with the inflatable bag and the other side in contact with the liner, the support surface further having a first edge substantially parallel to the first wall of the cargo container bulkhead, a second edge substantially parallel to the second side wall of the cargo container, and a third edge substantially parallel to the floor of the cargo container.

23. A liner assembly, as in claim 22, wherein the support surface and the inflatable bag are integrated into a single unit.

24. A liner assembly, as in claim 23, further comprising:

a flexible layer located above the support surface on the side opposite the inflatable bag;

a seal attaching the flexible layer to the inflatable bag around the periphery of the support surface such that the support surface is enclosed by the flexible layer and the inflatable bag.

25. A liner assembly, as in claim 22, further comprising attachment means to provide an input for air pumped under pressure to the inflatable bag.

26. A liner assembly, as in claim 25, further comprising means to vibrate the inflatable bag when the inflatable bag is in contact with the support surface such that the inflatable bag causes the support surface to vibrate.

27. A liner assembly, as in claim 26, wherein the means to vibrate the inflatable bag includes a flutter valve.

28. An active bulkhead corner, as in claim 26, wherein the means to vibrate the inflatable bag includes a mechanical vibrator.

29. An active bulkhead corner, as in claim 26, wherein the means to vibrate the inflatable bag includes a sonic vibrator.

30. A liner assembly, as in claim 22, further comprising means to vibrate the inflatable bag when the inflatable bag is in contact with the support surface such that the inflatable bag causes the support surface to vibrate.

31. A liner assembly, as in claim 30, wherein the means to vibrate the inflatable bag includes a flutter valve.

32. An active bulkhead corner, as in claim 30, wherein the means to vibrate the inflatable bag includes a mechanical vibrator.

33. An active bulkhead corner, as in claim 30, wherein the means to vibrate the inflatable bag includes a sonic vibrator.

34. A liner assembly, as in claim 23, further comprising attachment means to provide an input for air pumped under pressure to the inflatable bag.

35. A liner assembly, as in claim 34, further comprising means to vibrate the inflatable bag when the inflatable bag is in contact with the support surface such that the inflatable bag causes the support surface to vibrate.

36. A liner assembly, as in claim 35, wherein the means to vibrate the inflatable bag includes a flutter valve.

37. An active bulkhead corner, as in claim 35, wherein the means to vibrate the inflatable bag includes a mechanical vibrator.

38. An active bulkhead corner, as in claim 35, wherein the means to vibrate the inflatable bag includes a sonic vibrator.

39. A liner assembly, as in claim 23, further comprising means to vibrate the inflatable bag when the inflatable bag is in contact with the support surface such that the inflatable bag causes the support surface to vibrate.

40. A liner assembly, as in claim 39, wherein the means to vibrate the inflatable bag includes a flutter valve.

41. An active bulkhead corner, as in claim 39, wherein the means to vibrate the inflatable bag includes a mechanical vibrator.

42. An active bulkhead corner, as in claim 39, wherein the means to vibrate the inflatable bag includes a sonic vibrator.

43. A method for actively enhancing cargo flow while discharging cargo from a cargo container, comprising:

inflating an inflatable bag, positioned upon inflation in a corner of the cargo container at an intersection of a floor of the cargo container, a first wall of a cargo container bulkhead and a second side wall of the cargo container, the bag configured upon inflation to displace cargo from the corner of the cargo container;

locating a support surface in the corner of a cargo container, the support surface having one side in contact with the inflatable bag, the support surface further having a first edge substantially parallel to the first wall of the cargo container bulkhead, a second edge substantially parallel to the second side wall of the cargo container, and a third edge substantially parallel to the floor of the cargo container; and vibrating the inflatable bag when the inflatable bag is in contact with the support surface such that the inflatable bag causes the support surface to vibrate.

44. A method, as in claim 43, further including the step of vibrating the inflatable bag when the inflatable bag is in contact with the support surface such that the inflatable bag causes the support surface to vibrate.

45. A method, as in claim 44, further including the step of vibrating the inflatable bag with a flutter valve.

46. A method, as in claim 44, further including the step of vibrating the inflatable bag with a mechanical vibration generator.

47. A method, as in claim 44, further including the step of vibrating the inflatable bag with a sonic generator.

48. An active bulkhead corner, as in claim 5, wherein the means to cause the support surface to vibrate is attached to the bulkhead.

49. An active bulkhead corner, as in claim 5, wherein the means to cause the support surface to vibrate is attached to the cargo container.

50. An active bulkhead corner, as in claim 9, wherein the means to cause the support surface to vibrate is attached to the bulkhead.

51. An active bulkhead corner, as in claim 9, wherein the means to cause the support surface to vibrate is attached to the cargo container.

52. An active bulkhead corner, as in claim 14, wherein the means to cause the support surface to vibrate is attached to the bulkhead.

53. An active bulkhead corner, as in claim 14, wherein the means to cause the support surface to vibrate is attached to the cargo container.

54. An active bulkhead corner, as in claim 18, wherein the means to cause the support surface to vibrate is attached to the bulkhead.

55. An active bulkhead corner, as in claim 18, wherein the means to cause the support surface to vibrate is attached to the cargo container.

56. An active bulkhead corner, as in claim 44, wherein the means to cause the support surface to vibrate is attached to the bulkhead.

57. An active bulkhead corner, as in claim 44, wherein the means to cause the support surface to vibrate is attached to the cargo container.

* * * * *